US010850321B2

(12) United States Patent
Diel et al.

(10) Patent No.: US 10,850,321 B2
(45) Date of Patent: Dec. 1, 2020

(54) FOUNDRY CORE, USE OF A FOUNDRY CORE, AND METHOD FOR PRODUCING A FOUNDRY CORE

(71) Applicant: Nemak, S.A.B. de C.V., Garcia (MX)

(72) Inventors: Valentin Diel, Heusweiler (DE); Detlef Kube, Sundern (DE); Gerald Klaus, Saarbrucken (DE)

(73) Assignee: Nemak, S.A.B. de C.V., Garcia (MX)

( * ) Notice: Subject to any disclaimer, the term of this patent is extended or adjusted under 35 U.S.C. 154(b) by 0 days.

(21) Appl. No.: 15/324,411

(22) PCT Filed: Jul. 6, 2015

(86) PCT No.: PCT/IB2015/001121

§ 371 (c)(1),
(2) Date: Jan. 6, 2017

(87) PCT Pub. No.: WO2016/005806

PCT Pub. Date: Jan. 14, 2016

(65) Prior Publication Data

US 2017/0173670 A1 Jun. 22, 2017

(30) Foreign Application Priority Data

Jul. 9, 2014 (DE) ..... 10 2014 109 598

(51) Int. Cl.
*B22C 9/10* (2006.01)
*F02F 1/14* (2006.01)
(Continued)

(52) U.S. Cl.
CPC ..... *B22C 9/10* (2013.01); *B22C 1/22* (2013.01); *B22C 9/108* (2013.01); *B22C 9/24* (2013.01);
(Continued)

(58) Field of Classification Search
CPC .... B22C 9/00; B22C 9/02; B22C 9/10; B22C 9/103; B22C 9/108; B22C 9/22; B22C 9/24; B22C 1/22
See application file for complete search history.

(56) References Cited

U.S. PATENT DOCUMENTS 4,691,756 A * 9/1987 Suzuki ..... B22C 1/02 164/21
4,693,294 A 9/1987 Albrecht et al.
(Continued)

FOREIGN PATENT DOCUMENTS

CN 1374446 A 10/2002
DE 10033271 A1 1/2001
(Continued)

OTHER PUBLICATIONS

Brown, "Sands and Sand Bonding Systems", Foseco Non-Ferrous Foundryman's Handbook, 2002, pp. 148-153.
(Continued)

*Primary Examiner* — Kevin P Kerns
*Assistant Examiner* — Steven S Ha
(74) *Attorney, Agent, or Firm* — The Webb Law Firm

(57) ABSTRACT

A foundry core formed from a moulding sand, grains of which are bound together by a binder, and which is provided to form a cooling channel in an engine block for an internal combustion engine. The foundry core has a supporting section, two neck sections, which protrude from a lateral surface of the supporting section and are arranged at a distance from one another, and at least one bridge section which is held by the neck sections at a distance from the supporting section and a minimum thickness of which measured as the distance between its lateral surfaces is no more than 3 mm in an area which lies between the neck sections.

10 Claims, 4 Drawing Sheets

(51) Int. Cl.

| | |
|---|---|
| ***F02F 1/10*** | (2006.01) |
| ***B22C 1/22*** | (2006.01) |
| ***B22C 9/24*** | (2006.01) |

(52) U.S. Cl.
CPC ..... *F02F 1/10* (2013.01); *F02F 1/14* (2013.01); *F02F 2200/00* (2013.01)

(56) References Cited

U.S. PATENT DOCUMENTS

| | | | | |
|---|---|---|---|---|
| 6,205,959 | B1 | 3/2001 | Smetan et al. | |
| 6,298,899 | B1 | 10/2001 | Baltz et al. | |
| 6,575,124 | B2 * | 6/2003 | Shimizu | F02F 1/108 123/193.2 |
| 2002/0121250 | A1 | 9/2002 | Shimizu et al. | |
| 2005/0247428 | A1 | 11/2005 | Cantu-Gonzalez et al. | |
| 2008/0314549 | A1 * | 12/2008 | Gerlach | B22C 1/188 164/523 |
| 2010/0139884 | A1 | 6/2010 | Kube et al. | |
| 2010/0326620 | A1 * | 12/2010 | Muller | B22C 1/188 164/528 |

FOREIGN PATENT DOCUMENTS

| | | | | |
|---|---|---|---|---|
| DE | 102011105388 | A1 | 12/2012 | |
| DE | 102012110258 | A1 | 4/2014 | |
| EP | 0974414 | A1 | 1/2000 | |
| EP | 2727668 | A1 | 5/2014 | |
| JP | 2007130665 | A | 5/2007 | |
| JP | 2010509070 | A | 3/2010 | |
| WO | 2005102560 | A2 | 11/2005 | |
| WO | WO-2008029302 | A2 * | 3/2008 | B22C 1/185 |

OTHER PUBLICATIONS

Hasse, "Foundry Lexicon", 2001, pp. 438-439, 18th Edition.
Recknagel, "The Shell Moulding Process: A German Innovation", Giesserei-Praxis, 2007, pp. 182-184.
Le et al., Engineering Training Basic Tutorial, Sep. 2011, pp. 4-5, Chongqing University Press, 1st Edition.

* cited by examiner

FOUNDRY CORE, USE OF A FOUNDRY CORE, AND METHOD FOR PRODUCING A FOUNDRY CORE

CROSS-REFERENCE TO RELATED APPLICATIONS

This application is the United States national phase of International Application No. PCT/IB2015/001121 filed Jul. 6, 2015, and claims priority to German Patent Application No. 10 2014 109 598.7 filed Jul. 9, 2014, the disclosures of which are hereby incorporated in their entirety by reference.

BACKGROUND OF THE INVENTION

Field of the Invention

The invention relates to a foundry core which is formed from a moulding sand, the grains of which are bound together by a binder, and which is provided to form a cooling channel in an engine block for an internal combustion engine.

In addition, the invention relates to a use of such a foundry core and to a method for producing it, in which a moulding material, which comprises a moulding sand and a binder, is shot into a mould cavity of a core mould by means of a core shooting machine and subsequently the binder is hardened, in order to provide the foundry core with the required shape stability.

DESCRIPTION OF RELATED ART

Foundry cores of the type in question here form channels, cavities and other recesses as part of a casting mould in the component to be cast. Thus, for example the channels conveying coolant and also the cylindrically formed combustion chambers are formed in engine blocks for internal combustion engines by means of foundry cores.

Engine blocks of modern high-performance engines have to be intensively cooled in operation, in order to dissipate in a targeted way the large amounts of heat which are produced due to the high power density. This particularly applies to engine blocks which are produced from a light-metal material, such as an aluminium alloy. At the same time, particularly in the car industry, there is the requirement for more and more compactly constructed drive assemblies, so that, on the one hand, weight can be spared and so that, on the other hand, high-performance engines can be accommodated even in car bodies in which only very limited space is available.

The compact design leads to the cylinder recesses of a cylinder bank being arranged closely adjacent to one another. This results in correspondingly thin cylinder partition walls. These are exposed to increased thermal stress especially in the area of their end sections assigned to the cylinder head. Intensive cooling also has to be carried out in the vulnerable area in question, in order to prevent heat-induced cracks or other damage occurring here.

One possibility of introducing the cooling channel required for this purpose into the thin partition wall remaining between two cylinder chambers of an engine block involves boring the cooling channel into the block after the casting production process is complete. Although this method allows even channels which are very small and narrow in size to be precisely produced, it is in terms of production complex, since it requires a large number of additional production steps. This leads to high costs. A further disadvantage is that it is difficult from the point of view of production to introduce a channel bore with a minimised diameter into the upper area of the partition wall of an engine block present between adjacent cylinder recesses, in which in use the highest thermal stress occurs.

To avoid this effort and cost, various proposals have been put forward as to how during the casting production process thin and narrow channels can be introduced into the areas of an engine block which are thermally highly stressed in operation. Thus, cores consisting of the most diverse moulding materials have been proposed which have each been selected with the aim, on the one hand, of ensuring sufficient dimensional stability with regard to the delicate core section which is to form the respective channel in the cast part and, on the other hand, of guaranteeing that the core material can be removed as smoothly as possible after the engine block has solidified, so that a correct through-flow is guaranteed. However, the use of cores consisting of moulding materials reaches limits which are set by the dimensional stability and mechanical resilience which the cores must have in order to ensure that there is also sufficient productivity under the conditions prevailing in a foundry plant.

In order to be able to form channels with even smaller diameters in light-metal engine blocks, in EP 0 974 414 B1 it has been proposed to form these channels through a correspondingly dimensioned small glass pipe which is placed into the casting mould and is enclosed by the casting melt during casting. The material of the small glass pipe is chosen such that it breaks up into lots of small pieces under the stresses which occur in the course of solidification of the cast material which can subsequently be washed out without any difficulty.

Other proposals aimed in this direction make provision for forming the channels by means of sheet metal or wire inserts which are subsequently withdrawn from the finished cast part.

The above mentioned possibilities have proved themselves in the prior art with more or less great technical and economic success for producing channels which in spite of their limited dimensions are sufficiently large and accessible for the respectively remaining broken pieces of the core material forming them to be able to be removed.

However, with a new generation of internal combustion engines cast from aluminium material, the thickness of the partition walls has been reduced to the extent that the cooling channels required therein have a clear width of less than 3 mm in their narrowest section. With engine blocks of this type cast from aluminium material, the clear width of the cooling channels in the area where the partition wall between two cylinder chambers is at its narrowest is in the range from 1-2 mm.

SUMMARY OF THE INVENTION

Against the background of the prior art, an object of the invention was to create a foundry core which can be produced in a simple and operationally reliable way and also allows channels which at their narrowest point are at most 3 mm wide to be produced by casting.

Furthermore, a preferred use and a method for producing foundry cores which achieve this object is disclosed herein.

A foundry core according to the invention can be used in a casting mould for producing in a casting operation an engine block for an internal combustion engine by casting an aluminium melt in the casting mould, wherein the bridge section of the foundry core in the engine block forms a cooling channel arranged between two cylinder chambers of the engine block, the clear width of this cooling channel being at most 3 mm.

A foundry core according to the invention, which is provided to form a cooling channel in an engine block for an internal combustion engine, is accordingly fully formed from a moulding sand, the grains of which are bound together by a binder. According to the invention, the foundry core now has a supporting section, two neck sections, which protrude from a lateral surface of the supporting section and are arranged at a distance from one another, and at least one bridge section which is held by the neck sections at a distance from the supporting section and the minimum thickness of which measured as the distance between its lateral surfaces is no more than 3 mm in an area which lies between the neck sections. At the same time, at least in the area of its bridge section the foundry core is formed from a moulding sand, the grains of which have a mean diameter of at most 0.35 mm.

A foundry core according to the invention therefore fully consists of moulding sand, the grains of which, in a way which is known per se, are bound together by means of a suitable binder such that they form a solid body.

The supporting section of the foundry core allows the foundry core, despite the delicate design of its bridge section, to be taken hold of without difficulty, to be transported and to be inserted into a casting mould. Thus, the foundry core according to the invention can easily also be part of a casting mould formed as a core package. It can equally be used without difficulty in any other casting process, in which delicate channels with minimised dimensions are to be formed in or on the respective cast part.

The neck sections supported by the supporting section form the inflow and outflow channels in the engine block to be cast, via which the slender, narrowly dimensioned cooling channel is supplied with coolant, the cooling channel in each case being formed in the engine block by the bridge section supported by the neck sections. Its thickness is reduced to at most 3 mm in a critical area, wherein in practice the minimum thickness in this area is 1-2 mm. The critical area in question, in which the bridge section of the foundry core according to the invention is at its narrowest, is assigned to the area of the respective partition wall of the engine block to be cast where the partition wall is at its thinnest and the cylinder chambers separated by the partition wall come closest to one another.

It is critical here for the practical implementation of the invention that the foundry core is formed from a fine-grained moulding sand at least in the area of its bridge section. Its grain size is chosen such that the bridge section after casting disintegrates into fine particles in the solidified cast part, so that the remaining core broken pieces either automatically trickle out of the completely solidified engine block or can be washed out.

Surprisingly, it has also been shown that the foundry cores cannot only be produced in the conventional way by shooting in a core shooting machine, but they also provide a surface condition in the area of the narrow bridge section which produces sufficiently smooth inner surfaces in the cooling channel to be produced, without a coating application being required for this purpose. This particularly applies if the mean diameter of the grains of the moulding sand is at most 0.27 mm, in particular at most 0.23 mm.

As already mentioned, foundry cores according to the invention can be produced on an industrial scale, in which a moulding material, which comprises a moulding sand and a binder, is shot into a mould cavity by means of a core shooting machine and subsequently the binder is hardened, in order to provide the foundry core with the required shape stability, wherein according to the invention a moulding sand, the grains of which have a mean diameter of at most 0.35 mm, is used as the moulding material at least for the bridge area of the foundry core. Of course, it also applies here for the reasons explained above that the mean diameter of the grains is optimally not more than 0.27 mm, in particular at most 0.23 mm.

Optimum production results can be achieved with moulding materials, in which the moulding sand and the binder are not present as a mixture, but in which the grains of the moulding sand are each enveloped by a binder, wherein it also applies here that the mean diameter of the moulding sand grains enveloped in such a way is not greater than 0.35 mm. Moulding sands coated with binders of the type processed according to the invention are still used today for the so-called "Croning process", in the specialised technical language also called the "shell moulding process", and are provided, for example, under the designation VS744 (mean grain size 0.29 mm+/−0.02 mm) or VS1264 (mean grain size 0.21 mm+/−0.02 mm) from Hidttenes-Albertus Chemische Werke GmbH, Düsseldorf. The paper "The shell moulding process: A German innovation for casting production" by Ulrich Recknagel has also been published by Hüttenes-Albertus Chemische Werke GmbH, in which the technology and the history of the shell moulding process are described.

A particular advantage of using Croning moulding materials arises if the binder coating of the respective moulding sand grains is spherical in shape. The spherical shape ensures that the moulding material behaves particularly well when cores according to the invention are shot in a conventional core shooting machine. Therefore, foundry cores according to the invention can be produced with high operational reliability in spite of their minimised dimensions.

Foundry cores can not only be easily produced in a core shooting machine particularly when using more finely grained moulding sand with a mean grain size of 0.19-0.23 mm, but it has also been shown that the surface of the thin cooling channels formed by their bridge section in the respectively cast engine block consistently has a sufficient quality, without a coating or other surface-improving auxiliary agents, such as talc or suchlike, being required for this purpose.

Should it turn out, when using coarser sands with mean diameters of their preferably binder-coated grains of 0.27 mm or more, that the surface quality of the cooling channels formed in the cast part is not adequate, this can be remedied by applying a very thin coating or another agent commonly used to improve the surface at least to the bridge section. However, in the case of grain sizes of more than 0.35 mm, foundry cores with the dimensions specified according to the invention can no longer be reliably shot and the effort to be expended for smoothing out the coarse surfaces becomes so great that also from an economic point of view an application makes no sense. Therefore, optimally, those moulding sands whose grains coated with binder have a mean diameter of less than 0.27 mm, in particular less than 0.25 mm, are used for producing foundry cores according to the invention.

The binder, with which the grains of the moulding sands used according to the invention for producing the foundry cores are preferably enveloped or mixed, is typically a resin which as a result of the supply of heat adheres to the resin of the respectively adjacent grains and hardens, so that a firm composite is formed.

If, according to one embodiment of the invention, the lateral surfaces of the foundry core according to the invention each merge in a smooth transition into the peripheral surface of the neck sections and its thickness starting from a maximum thickness assigned to the respective neck section decreases continually in the longitudinal direction of the bridge section to the minimum thickness, this also contributes to operationally reliable production by conventionally shooting the cores in a core shooting machine. The smooth connection of the bridge section to the neck sections supporting it and the continual decrease in thickness have a hand in the fact that the moulding material also despite the minimised dimensions in the core shooting machine reliably and sufficiently tightly fills the cavity which forms the narrow bridge section of the foundry core.

The smooth connection of the bridge section to the neck sections can be simplified by the neck sections having a cross-sectional shape formed like a cam, the tip of which faces the respective other neck section. In this way, the lateral surfaces of the bridge section can nestle smoothly on the peripheral surface of the neck sections, whereby again filling of the bridge section with moulding sand during the core shooting operation is supported.

Foundry cores can be created in the manner according to the invention, which in their critical, minimally thick area not only have a thickness of at most 3 mm, in particular of 1-2 mm, and hence are suitable for forming cooling channels with a clear width of 3 mm and less, in particular 1.5+/−0.5 mm, but also in which the height is also minimised in the critical area. Consequently, in the case of a foundry core according to the invention the height of the bridge section can be limited to at most 4.5 mm in the area in which it has its minimum thickness.

In principle, it is conceivable for only the bridge section of a foundry core according to the invention to be formed from fine-grained moulding sand according to the invention, while the other sections of the foundry core consist of a coarser moulding sand. To that end, for example the bridge section consisting of the fine-grained sand could be shot separately from the other sections of the foundry core and subsequently joined, for example by bonding, to the remaining sections of the foundry core shot from coarser sand. However, in terms of production, it is easier if, according to a further embodiment of the invention, the foundry core is in each case completely formed in one piece from a moulding sand which meets the specifications according to the invention.

If the amount of heat to be dissipated necessitates this, a foundry core according to the invention can also be easily designed such that it forms more than one narrow casting channel in each thin partition wall of the engine block to be cast. For this purpose, two or more bridge sections which are arranged spaced apart from one another can be supported by the neck sections and each bridge section has an area in which the minimum thickness is at most 3 mm in each case. Of course, it also applies here that distinctly narrower minimum thicknesses, of for example 1-2 mm, are possible for the additional bridge sections.

A foundry core according to the invention is particularly suitable for use in a casting mould for producing in a casting operation an engine block for an internal combustion engine by casting an aluminium melt in the casting mould, wherein the bridge section of the foundry core in the engine block forms a cooling channel between two cylinder chambers of the engine block, the clear width of this cooling channel being at most 3 mm.

By means of the invention, in each internal combustion engine block, in which a narrow partition wall is formed between two cylinder openings, thin channels can be introduced into the respective partition wall. Of course, this includes the possibility when casting engine blocks which have more than two cylinder openings of forming at least one thin channel in each of the partition walls present between adjacent cylinder openings by means of a foundry core according to the invention in each case.

BRIEF DESCRIPTION OF THE DRAWINGS

The invention is explained in more detail below with the aid of the figures showing one exemplary embodiment.

DETAILED DESCRIPTION OF THE INVENTION

Figure 1:
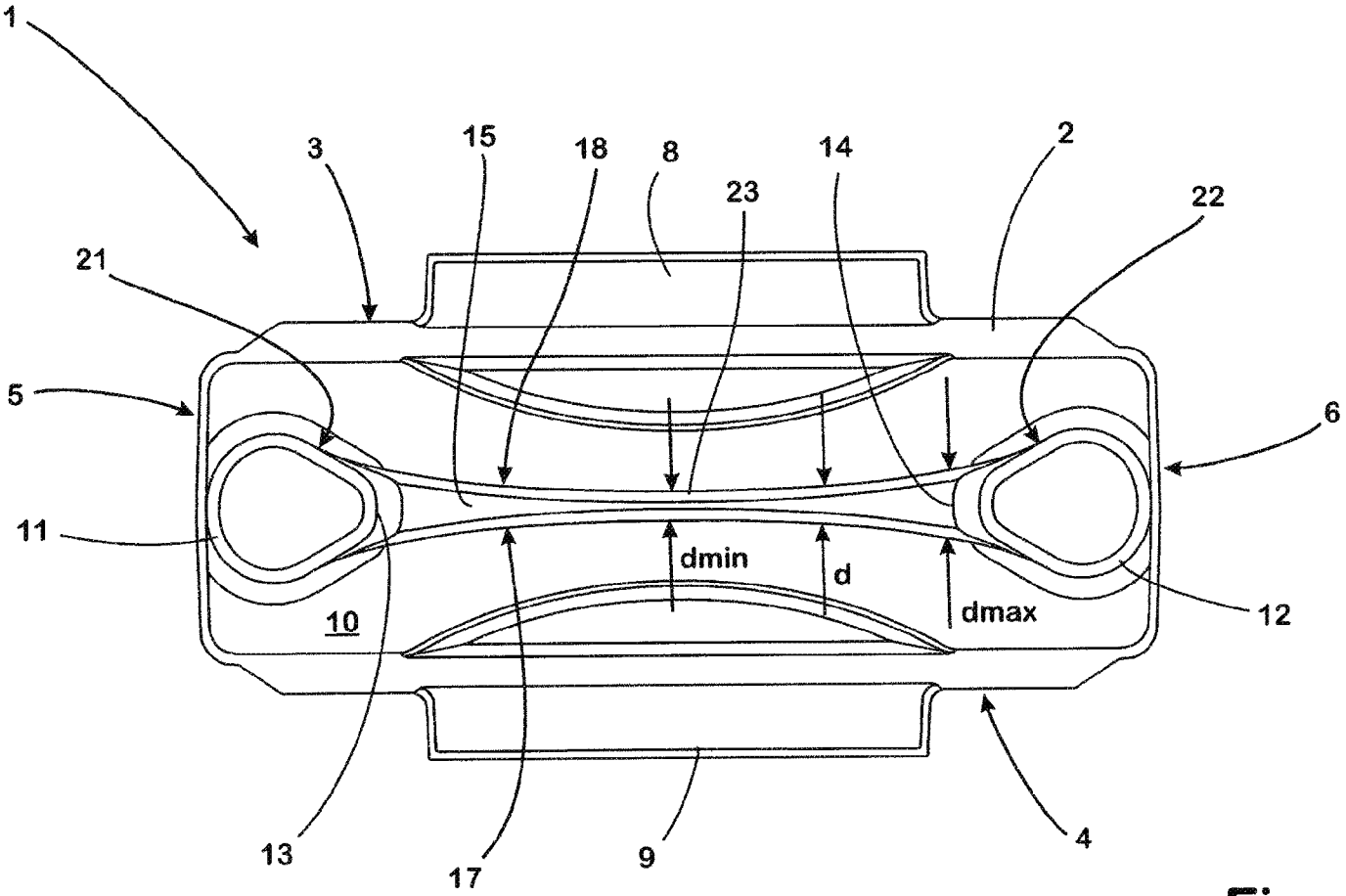
FIG. 1 schematically shows a foundry core in a view from below.
Figure 3:
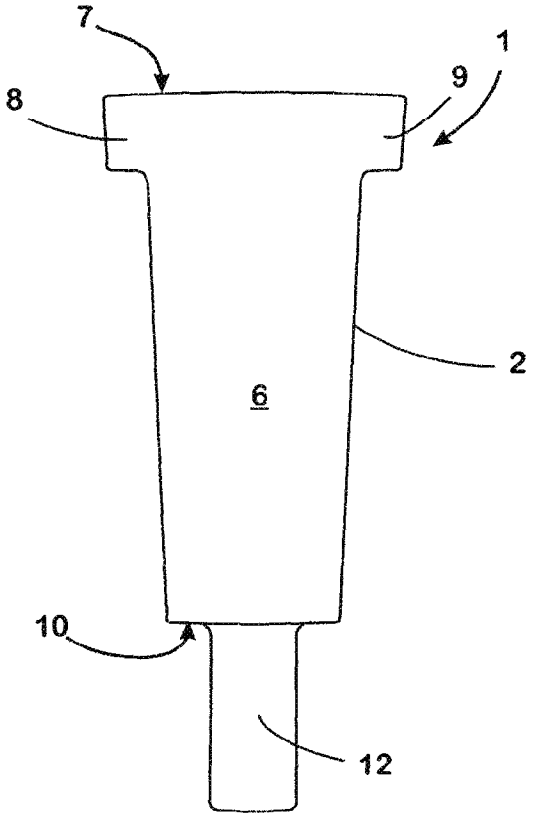
FIG. 3 schematically shows the foundry core in a view directed at its one narrow side.
Figure 2:
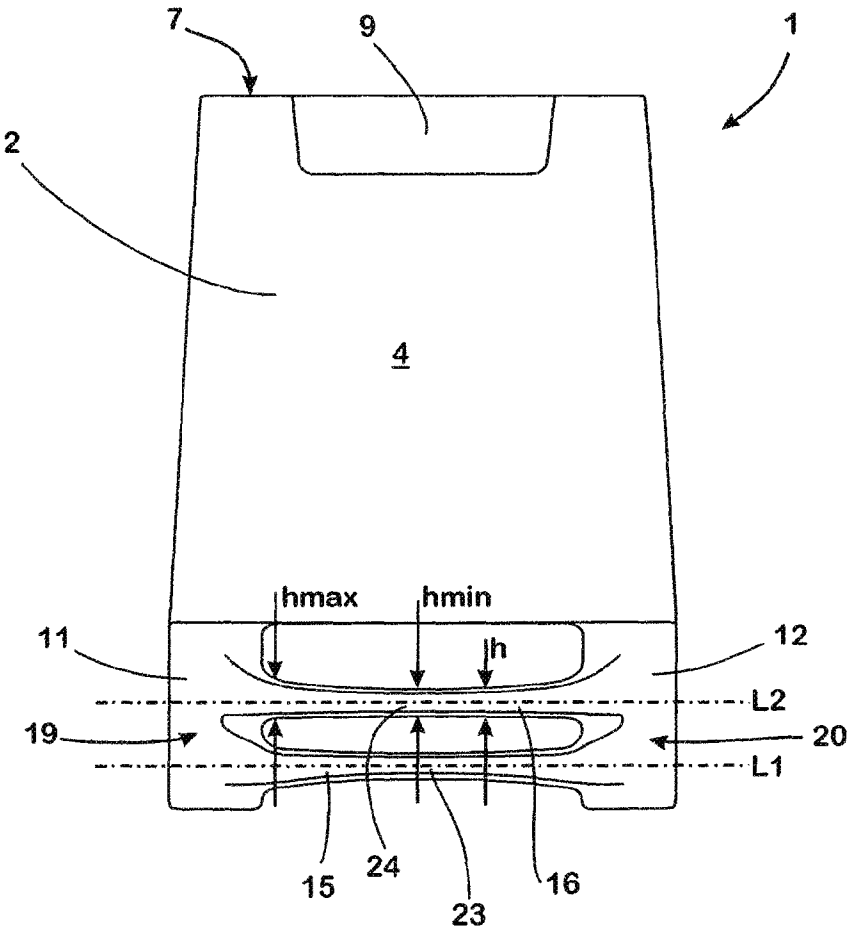
FIG. 2 schematically shows the foundry core in a view directed at its one wide side.

The casting mould 1 has a supporting section 2 which has the basic shape of a narrow truncated pyramid with opposing wide sides 3, 4 and likewise opposing narrow sides 5, 6 which join the wide sides 3, 4 to one another. Holding sections 8, 9 laterally protruding on the wide sides 3, 4 and extending over approximately one fifth of the height of the supporting section 2 are formed adjoining the upper face side 7.

In addition, on its lower plane face side 10, two neck sections 11, 12 are formed onto the supporting section 2 which extend axially parallel to one another and protrude perpendicularly aligned from the face side 10. The neck sections 11, 12 have a cam-like cross-sectional form, the cam tip 13, 14 of which respectively points in the direction of the respective other neck section 12, 11.

Two bridge sections 15, 16 extend between the neck sections 11, 12 in the longitudinal direction of the neck sections 11, 12 spaced apart from one another and from the face side 10 of the supporting section. The longitudinal axes L1, L2 of the bridge sections 15, 16 are aligned parallel to one another and to the face side 10 of the supporting section 2.

The bridge sections 15, 16 merge with their ends into the respectively assigned neck section 11, 12. To that end, the lateral surfaces 17, 18 of the bridge sections 15, 16 are thus nestled on the peripheral surface 19, 20 of the respective neck section 11, 12. They run out tangentially and smoothly into the peripheral surface section 21, 22 of the neck sections 11, 12 which extends between the cam tip 13, 14 and the thickest point in each case of the cross-section of the neck sections 11, 12.

At the respective connection point, where the bridge sections 15, 16 are joined to the respective neck section 11, 12, the thickness d of the bridge sections 15, 16 measured as the distance between its lateral surfaces 17, 18 corresponds to a maximum thickness dmax of approximately 5 mm, wherein in practice the thickness dmax can also be greater. Starting from this maximum thickness dmax, the thickness d of the bridge sections 15, 16 decreases continually in the direction of the respective other neck section 11, 12 until it reaches its minimum thickness dmin of approximately 1.5 mm in a central area 23, 24 arranged centrally between the neck sections 11, 12.

In a corresponding manner, the height h of the bridge sections 15, 16, which is measured as the distance between the upper side and the lower side of the bridge sections 15, 16, starting from a maximum height hmax at the respective connection point continually decreases in the direction of the central area 23, 24 until a minimum height hmin of approximately 4.3 mm is reached there.

The foundry core 1 was shot in one piece in a conventional core shooting machine (not shown here) from a commercially available so-called "Croning moulding sand", the quartz sand grains of which had a mean grain diameter of 0.21+/−0.02 mm (corresponding to AFS grain fineness number 68+/−3) and were coated with a synthetic resin serving as a binder. The moulding sand was to that end shot at a pressure of 2-6 bar into a core box heated to 200-350° C., in which the binding resin of the quartz sand grains are baked together and hardened due to the supply of heat occurring via the core box. After a dwell time of 30-120 seconds required for this purpose, the foundry core 1 could be removed from the core box. It had a sufficient shape stability, despite the delicate form of its bridge sections 15, 16, to be able to supply it for further use. It also had, particularly in the area of the bridge sections 15, 16, a uniformly finely ground surface, the quality of which was of such a high-grade that it could be directly supplied for further use. The application of a coating or of another auxiliary agent, which would have been necessary in the case of coarser surface structures in order to obtain the required quality, was not necessary.

Figure 4:
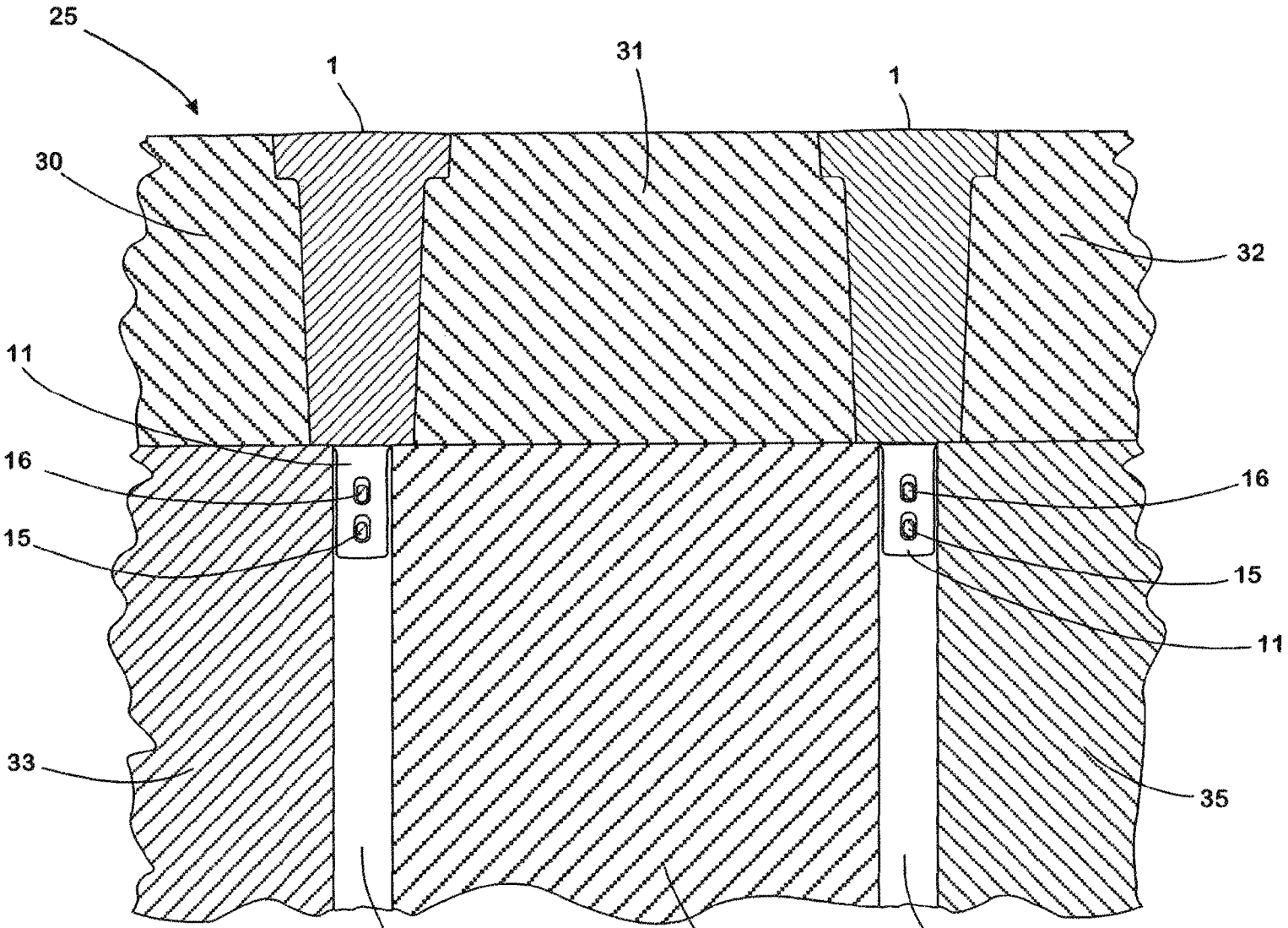
FIG. 4 schematically shows a part of a casting mould in a longitudinal section.
Figure 5:
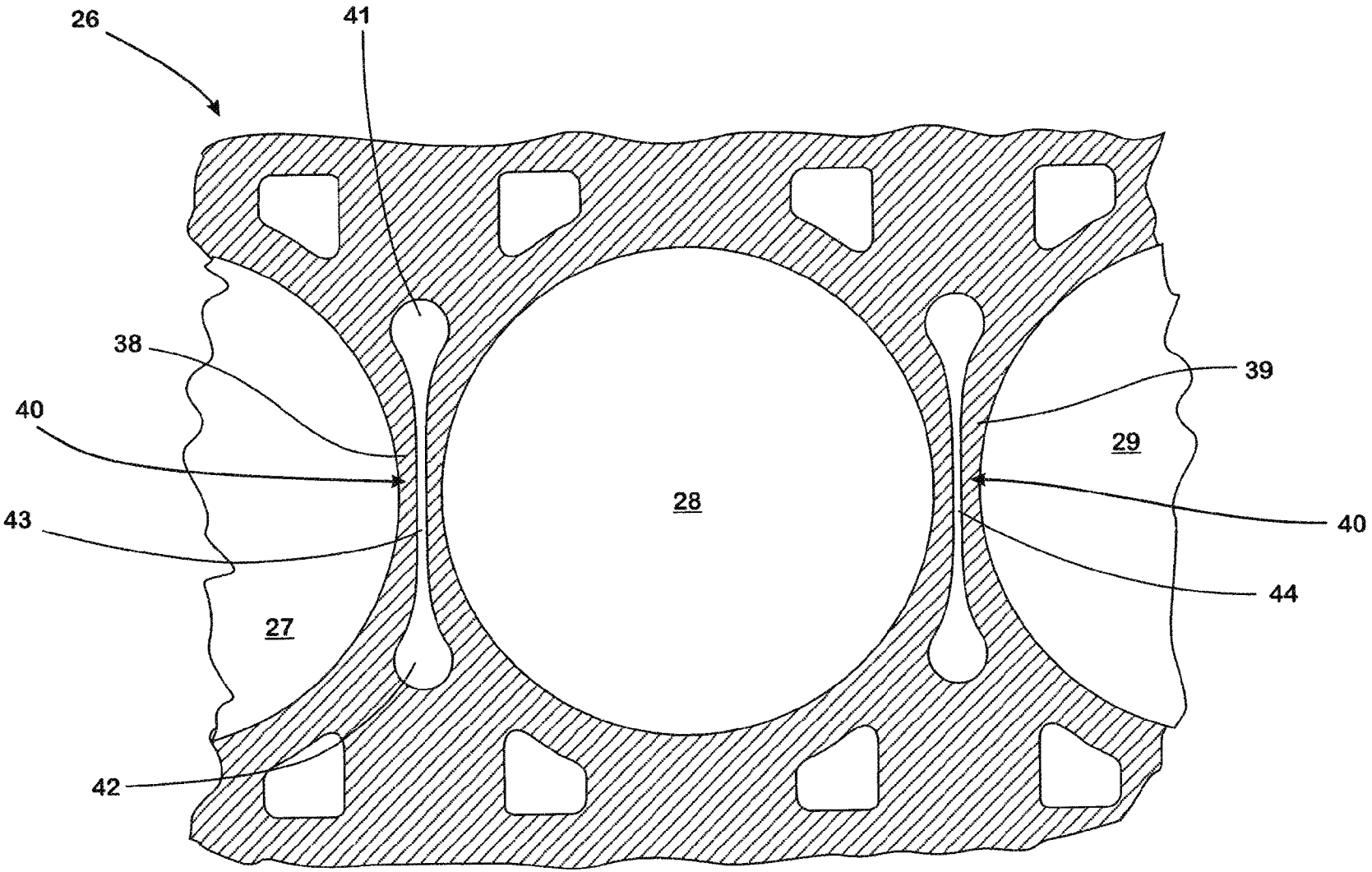
FIG. 5 schematically shows a part of an engine block in plan view.

Foundry cores 1 formed and produced in the manner mentioned above, are used as part of a casting mould 25 which is only shown in part in FIG. 4, is otherwise formed conventionally as a core package and is used for casting an engine block 26 for an internal combustion engine with cylinder chambers 27, 28, 29 arranged in a row which is cast from an aluminium fusible alloy and is also only shown in part in FIG. 5. The foundry cores 1 are arranged by means of covering cores 30, 31, 32 between the cylinder cores 33, 34, 35 forming the cylinder chambers 27-29, so that their bridge sections are arranged centrally in the upper area, which is assigned to the covering cores 30-32, of the narrow free space 36, 37 present between the cylinder cores 33-35. The respective free space 36, 37 forms the cylinder partition wall 38, 39 respectively in the finished engine block 26, by means of which the respectively adjacent cylinder chambers 27, 28; 28, 29 are separated from one another. In the area 40 in which the adjacent cylinder chambers 27, 28; 28, 29 come closest to one another, the minimal thickness dmin of the respective cylinder partition wall 38, 39 is approximately 5 mm.

After casting the aluminium fusible alloy in the casting mould 25, the aluminium cast material solidifies. The binder which binds the sand grains of the foundry core 1 begins to decompose due to the accompanying heat. The thermal energy introduced in this way is normally only sufficient to start the decomposition process. If the broken pieces of the foundry core 1 obtained as a consequence are still too large to trickle out of the channels formed by the foundry core 1, the core material is subsequently further broken up into small pieces in a known way by means of a targeted treatment. A suitable thermal treatment, also known in the specialised technical language under the term "thermal desanding", can be carried out for this purpose, in which the decomposition of the binder by the targeted supply of heat is continued and, as a consequence, the binding between the individual moulding material grains is broken up until such time as the moulding material is able to trickle out. Alternatively or additionally, breaking up the foundry core into small pieces can also be supported mechanically by exposing the casting mould or the cast part itself to hammer blows, knocking, shaking or vibrating. In order to optimise the removal of the broken up moulding material of the foundry core 1 from the respective channel, the respective channel can be additionally flushed with water or another liquid.

At least the neck and bridge sections 11, 12, 15, 16 of the foundry cores 1 decompose in this way into fine particles such that their moulding sand, despite the minimised dimensions of the channels formed by them, freely trickles out of the complete cast part or, if necessary, can be rinsed out.

The neck sections 11, 12 of the respective foundry core 1 can be coupled to a water jacket core (not shown here) which forms a cooling channel in the engine block 26, via which the walls of the engine block 26 defining the cylinder chambers 27-29 on their outsides are cooled. In this way, when the internal combustion engine is in operation, coolant flows via the inflow and outflow channels 41, 42 formed by the neck sections 11, 12 through the narrow cooling channels 43, 44, which are formed by means of the bridge sections 15, 16 and which in the area 40 are only approximately 1.5 mm wide and approximately 4.2 mm high, in the cylinder partition walls 38, 39 and provides effective cooling in the thermally highly stressed area of the cylinder partition walls 38, 39.

REFERENCE SYMBOLS

1 Foundry core
2 Supporting section
3, 4 Wide sides of the supporting section 2
5, 6 Narrow sides of the supporting section 2
7 Upper face side of the supporting section 2
8, 9 Holding sections
10 Lower plane face side of the supporting section 2
11, 12 Neck sections of the foundry core 1
13, 14 Cam tip of the neck sections 12, 11
15, 16 Bridge sections of the foundry core 1
17, 18 Lateral surfaces of the bridge sections 15, 16
19, 20 Peripheral surface of the neck sections 11, 12
21, 22 Peripheral surface section of the peripheral surface 19, 20
23, 24 Central area of the bridge sections 15, 16
25 Casting mould
26 Engine block
27, 28, 29 Cylinder chambers of the engine block 26
30, 31, 32 Covering cores
33, 34, 35 Cylinder cores
36, 37 Free space between the cylinder cores 33-35
38, 39 Cylinder partition walls of the engine block 26
40 Area in which the adjacent cylinder chambers 27, 28; 28, 29 come closest to one another
41, 42 Inflow and outflow channels of the engine block 26
43, 44 Cooling channels in the cylinder partition walls 38, 39
d Thickness of the bridge sections 15, 16
dmax Maximum thickness of the bridge sections 15, 16
dmin Minimum thickness of the bridge sections 15, 16
h Height of the bridge sections 15, 16
hmax Maximum height
hmin Minimum height
L1, L2 Longitudinal axes of the bridge sections 15, 16

The invention claimed is:

1. A method for producing a foundry core, which is intended for forming a cooling channel in an engine block for an internal combustion engine, the foundry core comprising a supporting section, two neck sections, which protrude from a lateral surface of the supporting section and are arranged at a distance from one another, and at least one bridge section which is held by the neck sections at a distance from the supporting section, the at least one bridge section comprising two lateral surfaces and having a minimum thickness, measured as the distance between the lateral surfaces and lying between the neck sections, that is 3 mm or less, wherein the foundry core consists of a moulding material, which comprises a moulding sand and a binder, wherein the moulding material is shot into a mould cavity of a core mould by a core shooting machine and subsequently the binder is hardened, in order to provide the foundry core with the required shape stability, and wherein at least the moulding material used for forming the bridge area of the foundry core is not a mixture of the moulding sand and the binder, and wherein at least the moulding material used for forming the bridge area of the foundry core comprises moulding sand wherein the grains of the moulding sand are each enveloped by the binder to form coated moulding sand and grains of the coated moulding sand have a mean diameter of 0.35 mm or less and are spherical in shape prior to being shot into the mould cavity of the core mould.

2. The method according to claim 1, wherein the lateral surfaces of the bridge section of the foundry core each merge in a transition into a peripheral surface of the neck sections of the foundry core and the thickness of the bridge section starting from a maximum thickness adjacent to each respective neck section decreases continually in a longitudinal direction of the bridge section to the minimum thickness.

3. The method according to claim 1, wherein the minimum thickness of the bridge section of the foundry core is 2 mm or less.

4. The method according to claim 1, wherein the minimum thickness of the bridge section of the foundry core is 1 mm or less.

5. The method according to claim 1, wherein a height of the bridge section in an area in which the bridge section has the minimum thickness is 4.5 mm or less.

6. The method according to claim 1, wherein the moulding material used for the entire foundry core comprises a moulding sand, the grains of which have a mean diameter of 0.35 mm or less.

7. The method according to claim 1, wherein the mean diameter of the grains of the moulding sand is 0.25 mm or less.

8. The method according to claim 1, wherein the mean diameter of the grains of the moulding sand is 0.23 mm or less.

9. The method according to claim 1, wherein the two neck sections have a cross-sectional shape formed like a cam, a tip of which faces the respective other neck section.

10. The method according to claim 1, wherein two or more bridge sections which are arranged spaced apart from one another are supported by the two neck sections and each of the bridge sections have an area in which a minimum thickness is 3 mm or less.

* * * * *